United States Patent [19]

Woldring

[11] 4,443,739

[45] Apr. 17, 1984

[54] ELECTRIC DEVICE COMPRISING AT LEAST ONE LOW-PRESSURE MERCURY VAPOR DISCHARGE TUBE

[75] Inventor: Leonard Woldring, Eindhoven, Netherlands

[73] Assignee: U.S. Philips Corporation, New York, N.Y.

[21] Appl. No.: 352,505

[22] Filed: Feb. 25, 1982

[30] Foreign Application Priority Data

Mar. 23, 1981 [NL] Netherlands ..... 8101408

[51] Int. Cl.[3] ..... H05B 37/00

[52] U.S. Cl. ..... 315/244; 315/185 R; 315/187; 315/250; 315/283

[58] Field of Search ..... 315/323, 185, 187, 244, 315/250, 283

[56] References Cited

U.S. PATENT DOCUMENTS

| | | | |
|---|---|---|---|
| 2,465,031 | 3/1949 | Nathanson | 315/185 R |
| 2,853,653 | 9/1958 | Williams | 315/323 |
| 3,324,349 | 6/1967 | Moerkens et al. | 315/323 |
| 3,986,076 | 10/1976 | Rottier | 315/244 |
| 4,017,761 | 4/1977 | Woldring | 315/289 |
| 4,039,895 | 8/1977 | Chermin et al. | 315/205 |
| 4,152,628 | 5/1979 | Rottier | 315/244 |
| 4,380,719 | 4/1983 | Di Bijl et al. | 315/244 |

OTHER PUBLICATIONS

"Fluorescent Lamp & Lighting" by Elenbaas et al., (1962), pp. 94–100, (Publisher Cleare-Hume Press London).

*Primary Examiner*—Harold Dixon

*Attorney, Agent, or Firm*—Robert T. Mayer; Bernard Franzblau

[57] ABSTRACT

An electric device comprising at least one low-pressure mercury vapor discharge tube intended to be connected to an AC voltage source at a frequency of 50 to 60 Hz. The discharge tube is of a type which produces a comparatively large current distortion and has a proportionally low required reignition voltage. The electric device produces relatively small electric losses. The discharge tube remains operative even for small deviations of the nominal AC supply voltage.

7 Claims, 3 Drawing Figures

ELECTRIC DEVICE COMPRISING AT LEAST ONE LOW-PRESSURE MERCURY VAPOR DISCHARGE TUBE

This invention relates to an electric device comprising at least one low-pressure mercury vapour discharge tube and two input terminals intended for connection to an a.c. voltage source at a frequency of 50 to 60 Hz. The input terminals are interconnected by means of a series arrangement of at least the low-pressure mercury vapour discharge tube, a capacitor and a coil, the capacitor impedance exceeding the coil impedance at the above-mentioned frequency. In the operating condition the (overall) arc voltage of the low-pressure mercury vapour discharge tube (tubes), which form a part of the series arrangement, is between 80% and 110% of the nominal voltage between the input terminals.

A known electric device of the said type is, for example, described in U.S. Pat. No. 4,017,761. A disadvantage of that known device is that a second coil is present. That second coil is arranged in parallel with the discharge tube (discharge tubes). In the operating condition of the discharge tube (tubes) said second coil results in additional electric losses of that electric device.

The invention has for an object to provide an electric device of the type defined in the preamble wherein, in the operating condition, no parallel coil is required and the electric losses are small.

According to the invention, an electric device of the type comprising at least one low-pressure mercury vapour discharge tube and having two input terminals, said input terminals being intended for connection to an a.c. voltage source the frequency of which is 50 to 60 Hz, and said input terminals being interconnected by means of a series arrangement of at least the low-pressure mercury vapour discharge tube, a capacitor and a coil, the capacitor impedance exceeding the coil impedance at the above-mentioned frequency, and in the operating condition the (overall) arc voltage of the low-pressure mercury vapour discharge tube (tubes), which form part of the series arrangement, is between 80% and 110% of the nominal voltage between the input terminals, is characterized in that each low-pressure mercury vapour discharge tube which is part of the series arrangement is of a type which:

(a) if operated by means of a reference ballast e.g. in accordance with IEC publication No. 82 has a lamp $\alpha$ value located between 0.5 and 0.85 if the rms voltage between two ends of a series arrangement formed by the reference ballast and the low-pressure mercury vapour discharge tube is approximately twice the arc-voltage of the discharge tube; and also (b) in the presence of the nominal voltage between the input terminals of the electric device has a required reignition voltage which is less than (170/n)% of the effective nominal voltage between the input terminals of the electric device, wherein n represents the number of low-pressure mercury vapour discharge tubes in the series arrangement of the electric device.

An advantage of this electric device is that in the operating condition of the discharge tube (tubes) no parallel coil is required and that the electric losses are small. A further advantage is that—in spite of the absence of the parallel coil—the discharge tube (tubes still remains (remain) operative, even for small deviations of the nominal voltage between the input terminals of the electric device. This will be explained in greater detail hereinafter. First, the reference ballast and the lamp $\alpha$ will be described briefly.

A reference ballast is mentioned in publication No. 82 of the IEC (International Electrotechnical Commission) entitled "Ballasts for tubular fluorescent lamps" ("Ballasts pour lampes tubulaires a fluorescence") 4th edition, 1980. In brief, a reference ballast is an inductive ballast having a substantially constant ratio between the voltage across that ballast and the current through that ballast.

$\alpha$ is understood to mean:

$$\text{the quotient } \frac{\frac{1}{\pi}\int_0^{\pi} i.v.dwt}{I.V.},$$

in which:

i is the instantaneous value of the current, in amperes, through the discharge tube;

v is the instantaneous value of the voltage, in volts, across the discharge tube;

$w=2\pi f$, wherein f represents the frequency in Hz, t is the time in seconds;

I is the effective current, in amperes, through the discharge tube: and

V is the rms voltage, in volts, across the discharge tube.

$\alpha$ is a distortion factor of the electric current, which relates to the circumstance that a discharge tube presents a different electric load than, for example, an ohmic resistance. The notion "$\alpha$" is described in, for example, "Fluorescent lamps", W. Elenbaas, Philips Technical Library 1971, page 108. At a combination of a substantially constant voltage v across the discharge tube and a sinusoidal change of the current i through the discharge tube, $\alpha$ lamp amounts to: 0.9.

A smaller lamp $\alpha$, when operated from a reference ballast, may, for example, be obtained by opting for a small cross-section of the discharge tube. The discharge tube may alternatively be filled with, for example, glass wool. See, for example, U. S. Pat. No. 4,163,169.

The "required reignition voltage" is understood to mean the minimum instantaneous voltage across the discharge tube which must be present in each half cycle of the tube voltage supply in order to reignite said discharge tube. With an electric arrangement in accordance with the invention, the discharge tube reignites at a combination of the instantaneous AC supply voltage and a residual voltage on the ballast capacitor. The required reignition voltage of a low-pressure mercury vapour discharge tube depends, inter alia, on the composition of the filler gas, which consists, for example, of a mixture of rare gases. Also the pressure of the filler gas influences the required reignition voltage.

The following should be noted as regards the inventive idea. The second coil in the electric device described in the U.S. Pat. No. 4,017,761, mentioned in the foregoing, has for its object to make available in each half cycle of the supply a high voltage across the discharge tube to cause said discharge tube to reignite each time the current has passed through zero.

It has surprisingly been found that in an electric device in accordance with the invention the discharge tube reignites readily, in spite of the absence of the second coil. It is conceivable that this is effected by a proportionally high residual voltage on the capacitor shortly after the current through the discharge tube has passed through zero. This may be caused by the effect that after said zero crossing the relevant discharge tube, having a low lamp $\alpha$ between 0.5 and 0.85, is high-ohmic. This would namely block the discharge of the capacitor, causing the combination of the instantaneous AC supply voltage and the residual voltage on the capacitor to increase in a short period of time until the required reignition voltage of the discharge tube is reached. Said discharge tube reignites thereupon. If the lamp $\alpha$ exceeds 0.85, the lamp does not reignite, or at least less reliably. A lamp $\alpha$ of less than 0.5 has the disadvantage that the system efficiency of the device—for example expressed in lumens per Watt—becomes comparatively low.

The required reignition voltage of the discharge tube of an electric device in accordance with the invention must remain below a predetermined value in accordance with the condition b mentioned in the foregoing. Said required reignition voltage must namely be lower than the voltage which is available for reigniting the discharge tube. The available voltage depends inter alia on the number (n) of discharge tubes in the series circuit. This voltage is lower according as n is higher.

It also appears that for a voltage between the input terminals of an electric device according to the invention which deviates to a small extent from the nominal voltage between the terminals the discharge tube (tubes) remain operative.

The invention is based on the notion to realise a simple operating circuit by choosing a low-pressure mercury vapour discharge tube having a comparatively low lamp $\alpha$ and a proportionally low required reignition voltage. It has been found that then small deviations from the nominal input voltage do not extinguish the discharge tube.

It should be noted that an electric device comprising a high-pressure mercury vapour discharge tube and having two input terminals, said input terminals being intended for connection to an a.c. voltage source the frequency of which is 50 to 60 Hz, and said input terminals being interconnected by means of a series arrangement of at least the high-pressure mercury vapour discharge tube, a capacitor and a coil, the capacitor impedance exceeding at the above-mentioned frequency the coil impedance, and in the operating condition the arc voltage of the high-pressure mercury vapour discharge tube being substantially equal to the voltage between the input terminals, and the high-pressure mercury vapour discharge tube being of a type whose required reignition voltage is below a predetermined value, is known per se from United Kingdom Patent Specification No. 487,469 (PHZ 4945). However, said Patent Application does not relate to a low-pressure mercury vapour discharge tube but to a high-pressure mercury vapour discharge tube. In addition, said British Patent Specification does not furnish any information on the influence of AC supply voltage variation on the continued functioning of the discharge tube.

In a preferred embodiment of an electric device in accordance with the invention the impedance of the coil at the specified frequency has been given such a low value—and consequently the current intensity in each individual low-pressure mercury vapour discharge tube which form part of the series arrangement is of such a high value—that in the operating condition with a nominal voltage between the input terminals the mercury vapour pressure in the discharge tube is between 0.4 and 2 Pascal, and the discharge tube is of a type the arc voltage—mercury vapour pressure characteristic of which has a maximum in the pressure range from 0.4 to 2 Pascal.

An advantage of this preferred embodiment is that at the customary AC supply voltage variations (in the range between 90% and 110% of the nominal AC supply voltage) a very reliable reignition of said discharge tube (tubes) can be obtained. An additional advantage is that the luminous efficacy (for example expressed in lumens/Watt) is comparatively large.

It should be noted that it is known that in a low-pressure mercury vapour discharge tube an optimum conversion of electrical energy into radiation is accomplished at a mercury vapour pressure of approximately 0.75 Pascal.

It is conceivable that the low-pressure mercury vapour discharge tube of an electric device in accordance with the invention is provided with an amalgam.

In another preferred embodiment of an electric device in accordance with the invention each individual low-pressure mercury vapour discharge tube which forms part of the series arrangement is circular cylindrical and has an inside diameter of approximately 24 mm, and that discharge tube contains a rare gas containing at least 50 at.% krypton the filling pressure of which amounts from 100 to 300 Pascal. An advantage of this preferred embodiment is that the system efficiency of the electric device is comparatively high.

In a further preferred embodiment of an electric device in accordance with the invention which is intended to be connected to an a.c. voltage source of a nominal voltage of 220 volts and 50 Hz, the series arrangement of the electric device is provided with two-substantially identical-low-pressure mercury vapour discharge tubes, and the arc voltage of each of those discharge tubes is 100 to 110 volts. An advantage of this preferred embodiment is that the electric device may be provided with low-pressure mercury vapour discharge tubes of a standard type.

The invention will now be further described by way of example with reference to the accompanying drawing in which.

Figure 1:
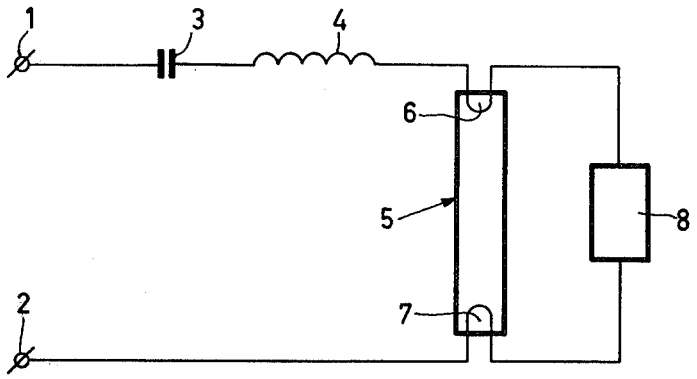
FIG. 1 shows an electric device in accordance with the invention provided with a low-pressure mercury vapour discharge tube.

In FIG. 1, reference numerals 1 and 2 denote input terminals which are intended to be connected to a supply voltage of approximately 118 volts, 60 Hz. The terminals 1 and 2 are interconnected by means of a series arrangement of a capacitor 3, a coil 4, and a low-pressure mercury vapour discharge tube 5 of approximately 36 Watts. Tube 5 has two preheatable electrodes 6 and 7. The sides of the electrode 6 and 7 which face away from the terminals 1 and 2 are interconnected by a starter 8. The starter 8 is, for example, of a relay type as described in U.S. Pat. No. 4,152,628 or of the type described with reference to FIG. 2.

If the terminals 1 and 2 are connected to the relevant supply source, a current first flows through the circuit 1, 3, 4, 6, 8, 7, 2. This causes the electrodes 6 and 7 of the discharge tube 5 to be heated. After some time the starter 8 will be rendered non-conductive as a result of which, by means of a voltage peak generated therefor in the coil 4, a high voltage will be produced between the electrodes 6 and 7 as a result of which the tube 5 ignites. The starter 8 then remains inoperative. Then only the circuit 1, 3, 4, 6, 7, 2 is in operation. Each time, after the current has passed through zero, the discharge tube 5 reignites on the combination of the residual voltage across the capacitor 3 and the instantaneous value of the input voltage between the terminals 1 and 2. In a practical embodiment the capacitor has a value of approximately 5.8μ Farad and the coil 4 has a value of approximately 0.47 Henry. The circular-cylindrical low-pressure mercury vapour discharge tube 5 has:

an electrode spacing of approximately 112 cm,
an inside diameter of approximately 2.4 cm,
mercury in the discharge tube approximately 15 mgram,
and the rare gas in the discharge tube comprises
krypton 75 at.% and
argon 25 at.%.

The filling pressure (at 300 Kelvin) is approximately 200 Pascal and the arc voltage is approximately 103 volts.

When operated from a reference ballast in accordance with the IEC publication No. 82 the lamp α of the discharge tube 5 is approximately 0.8, i.e. located between 0.5 and 0.85.

The nominal voltage of 118 volts, 60 Hz, being available between the input terminals 1 and 2, the required reignition voltage of the discharge tube 5 is approximately 180 volts, i.e. less than (170/n)% of 118 Volts=200 Volts, where n=1 for the case of FIG. 1.

The system efficiency of this electric device is approximately 84 lumen/Watt.

Figure 2:
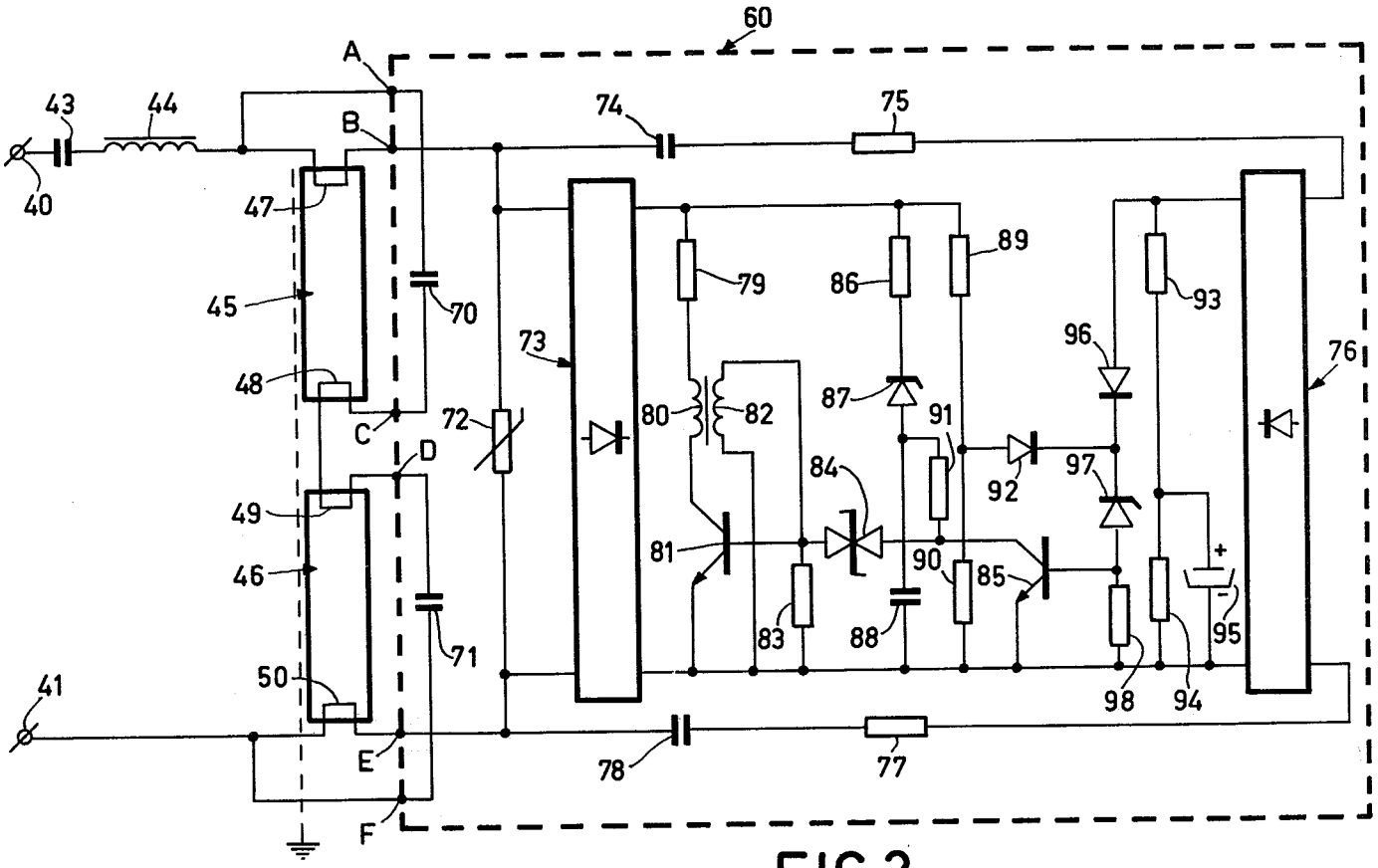
FIG. 2 shows a second electric device in accordance with the invention comprising two series-arranged, low-pressure mercury vapour discharge tubes.

In FIG. 2 reference numerals 40 and 41 denote input terminals of a second electric device in accordance with the invention. The terminals 40 and 41 are intended to be connected to a supply voltage of nominal 220 Volts, 50 Hz. The terminals 40 and 41 are interconnected by a series arrangement of a capacitor 43, a coil 44, and two low-pressure mercury vapour discharge tubes 45 and 46 which are arranged in series with each other. The tubes 45 and 46 each comprise two preheatable electrodes 47, 48 and 49, 50, respectively. The electrodes 47 and 50 are interconnected via a lamp starter 60. There now follows a description of the lamp starter 60.

The starter 60 has six input terminals: A, B, C, D, E, F. The terminal A is connected to a junction of the coil 44 and the electrode 47. The terminal B is connected to that side of electrode 47 which faces away from the terminal 40. The terminal C is connected to the electrode 48 and the terminal D to the electrode 49. The terminal E is connected to that side of electrode 50 which faces away from the terminal 41. The terminal F is connected to the input terminal 41.

The terminal A is connected to the terminal C via a capacitor 70. The terminal D is connected to the terminal F via a capacitor 71.

A spike suppressor 72 and a first diode bridge 73 are connected between the terminals B and E. Terminal B is also connected to terminal E by a series arrangement of a capacitor 74, a resistor 75, a second diode bridge 76, a resistor 77 and a capacitor 78.

The output terminals of the first diode bridge 73 are interconnected by means of a series arrangement of a resistor 79, a winding 80 of a transformer, and a transistor 81. A further winding 82 of said transformer connects the base to the emitter of the transistor 81. Said base and emitter are also interconnected by a resistor 83.

Via a bidirectional threshold element (silicon bilateral switch) (SBS) 84 the base of the transistor 81 is connected to the collector of an auxiliary transistor 85. The emitter of this auxiliary transistor 85 is connected to the emitter of the transistor 81.

A second series arrangement of a resistor 86, a zener diode 87 and a capacitor 88, and also a third series arrangement of two resistors 89 and 90, respectively are arranged in parallel with the series arrangement 79, 80, 81.

Via a resistor 91 a tapping point between the Zener diode 87 and the capacitor 88 is connected to a junction of the threshold element 84 and the collector of the auxiliary transistor 85. A tapping point between the resistors 89 and 90 is connected to a diode 92.

Two output terminals of the second diode bridge are interconnected by means of a series arrangement of two resistors 93 and 94. Resistor 94 is by-passed by a capacitor 95. The said two output terminals of the second diode bridge 76 are interconnected by means of a series arrangement of a diode 96, a zener diode 97 and a resistor 98. The resistor 98 connects the base to the emitter of the auxiliary transistor 85. The cathode of the diode 92 is connected to a junction of the diode 96 and the zener diode 97.

The starter 60 described in the foregoing has some resemblance to the starter in U.S. Pat. No. 4,039,895.

With the starter 60 a number of reignition pulses having a low peak value are first generated and thereafter a number of starting pulses having a high peak value. The starter 60 is made inoperative after some time as a result of the fact that the auxiliary transistor 85 has become conductive.

In a practical embodiment the capacitor 43 has a value of approximately 3.7μ Farad, and the coil 44 has a value approximately 1.3 Henry.

The lamps 45 and 46 are of a similar type to the tube 5 of the device shown in FIG. 1. This means inter alia that the lamp α operated from the reference ballast mentioned in the foregoing amounts to 0.8.

The capacitor 70 has a value of approximately 68 nF.
The capacitor 71 has a value of approximately 22 nF.
The capacitor 74 has a value of approximately 100 nF.
The capacitor 78 has a value of approximately 100 nF.
The capacitor 95 has a value of approximately 15 μF.
The transformation ratio of the transformer 82-80 is approximately 1:1.
The resistor 75 has a value of approximately 270 kΩ.
The resistor 77 has a value of approximately 270 kΩ.
The resistor 86 has a value of approximately 20 kΩ.
The resistor 89 has a value of approximately 360 kΩ.
The resistor 90 has a value of approximately 10 kΩ.
The resistor 91 has a value of approximately 22 kΩ.
The resistor 93 has a value of approximately 1.5 kΩ.
The resistor 94 has a value of approximately 120 kΩ.
The resistor 98 has a value of approximately 22 kΩ.
The zener voltage of the zener diode 87 is approximately 180 Volts.
The zener voltage of the zener diode 97 is approximately 15 Volts.

In this embodiment the lamp current is approximately 475 mA. The required reignition voltage for each of the two discharge tubes is less than 170/n% of 220 Volts=187 Volts (n=2 in this case).

The system efficiency is approximately 90 lumen/-Watt.

Figure 3:
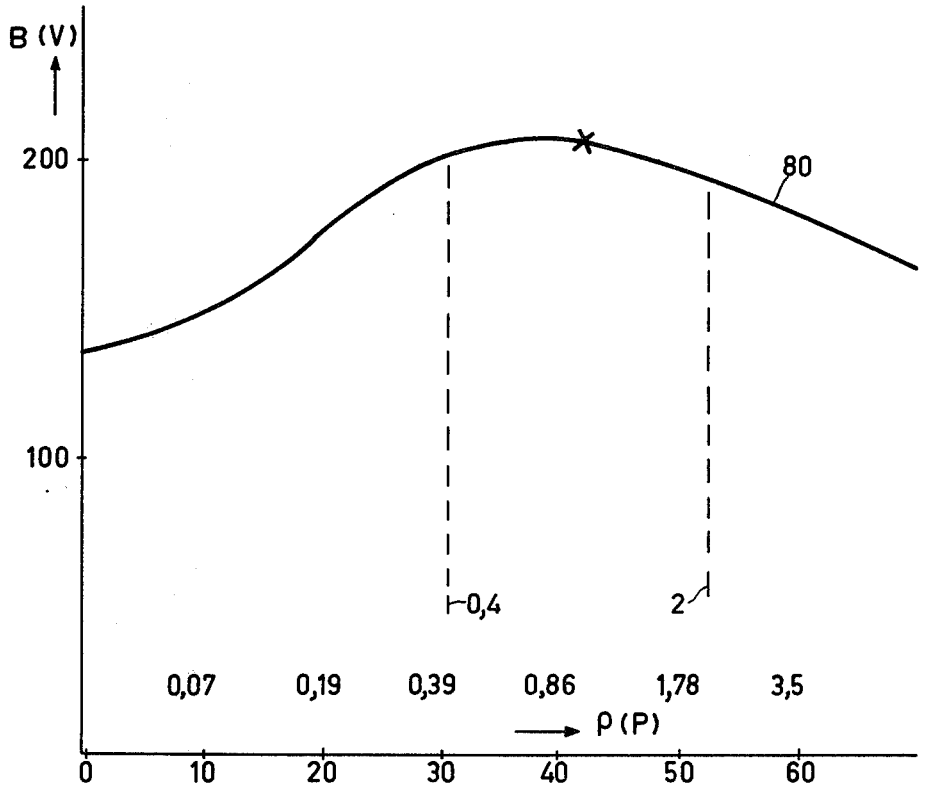
FIG. 3 is the arc voltage-mercury vapour pressure characteristic of the assembly of discharge tubes shown in FIG. 2.

In FIG. 3—by means of curve 80—there is plotted the overall arc voltage B in Volts of the discharge tubes 45 and 46 of the example of FIG. 2, versus the mercury vapour pressure P (in Pascal). Also the temperature T in °C. of the coldest spot of the discharge tube wall is plotted in FIG. 3. The limits of 0.4 and 2 Pascal are shown in FIG. 3 by means of two broken lines. From this Figure it appears that the arc voltage has a maximum in said mercury vapour pressure interval.

The cross on the curve 80 shows the operating point in the event that the nominal voltage of 200 Volts, 50 Hz is present between the input terminals 40 and 41 of the electric device shown in FIG. 2.

The two electric devices described have only a small ballast and starter and reignite reliably in the voltage interval of plus or minus 10% of the nominal AC supply voltage.

It is conceivable that an electric device in accordance with the invention is arranged in the form of a lamp unit as, for example, described in U.S. Pat. No. 4,393,325.

What is claimed is:

1. An electric device comprising, at least one low-pressure mercury vapour discharge tube, two input terminals for connection to an a.c. voltage source at a frequency of 50 to 60 Hz, means interconnecting said input terminal by means of a series arrangement of the low-pressure mercury vapour discharge tube, a capacitor and a coil wherein the capacitor impedance is greater than the coil impedance at the source frequency, and wherein in the tube operating condition the overall arc voltage of the low-pressure mercury vapour discharge tube (tubes) is between 80% and 110% of the nominal voltage between the input terminals, characterized in that each low-pressure mercury vapour discharge tube which forms part of the series arrangement is of a type which:

(a) if operated by means of a reference ballast has a lamp $\alpha$ in the range between 0.5 and 0.85 if the rms voltage between two ends of a series arrangement formed by the reference ballast and the low-pressure mercury vapour discharge tube is approximately twice the arc voltage of the discharge tube; and (b) in the presence of the nominal voltage between the input terminals of the electric device has a required reignition voltage which is less than 170/n% of the effective nominal voltage between the input terminals of the electric device, wherein n represents the number of low-pressure mercury vapour discharge tubes in the series arrangement of the electric device.

2. An electric device as claimed in claim 1 characterized in that: each individual low-pressure mercury vapour discharge tube of the series arrangement is circular-cylindrical with an inside diameter of approximately 24 mm, and the discharge tube contains a rare gas having at least 50 at.% krypton the filling pressure of which is 100 to 300 Pascal.

3. An electric device as claimed in claim 2 for connection to an a.c. voltage source having a nominal voltage of 220 Volts and 50 Hz, characterized in that the series arrangement of the electric device includes two substantially identical low-pressure mercury vapour discharge tubes wherein the arc voltage of each of said discharge tubes is 100 to 110 Volts.

4. A supply circuit for a load including at least one low-pressure mercury vapor lamp comprising, a pair of input terminals for applying an AC supply voltage to the load, a capacitor, an inductor, means connecting the capacitor, the inductor and said one lamp in series circuit across said input terminals, wherein the combination of the capacitor and the inductor exhibit a net capacitive impedance at the frequency of the AC supply voltage, the overall arc voltage of the lamp load being in the range between 80% and 110% of the nominal supply voltage at the input terminals, and wherein each discharge lamp of the load has a lamp $\alpha$ of 0.85 or less when the rms voltage across a series arrangement of a reference ballast and said discharge lamp is approximately twice the lamp arc voltage and each said lamp has a reignition voltage less than 170/n% of the effective nominal voltage between said input terminals, wherein n is the number of discharge lamps serially connected in the load.

5. A supply circuit as claimed in claim 4 wherein the discharge lamp includes preheatable electrodes, said supply circuit further comprising a substantially inductance-free starting circuit coupled to the lamp electrodes so that a heating current can flow from the input terminals through the lamp electrodes via the starting circuit prior to lamp ignition.

6. A supply circuit as claimed in claim 4 wherein the load includes first and second low-pressure mercury vapor discharge lamps serially connected and further comprising an electronic starting circuit coupled across said first and second discharge lamps.

7. A supply circuit as claimed in claim 4 wherein each discharged lamp of the load has a lamp $\alpha$ of at least 0.5.

* * * * *